US006886302B2

(12) United States Patent
Jackson

(10) Patent No.: US 6,886,302 B2
(45) Date of Patent: May 3, 2005

(54) MODULAR DECK DRAINAGE SYSTEM

(76) Inventor: Anslem Jackson, 25214 Dunnegan Sq., South Riding, VA (US) 20152

( * ) Notice: Subject to any disclaimer, the term of this patent is extended or adjusted under 35 U.S.C. 154(b) by 0 days.

(21) Appl. No.: 10/225,281

(22) Filed: Aug. 22, 2002

(65) Prior Publication Data

US 2004/0035069 A1 Feb. 26, 2004

(51) Int. Cl.[7] ..... E04B 1/70

(52) U.S. Cl. ..... 52/302.3; 52/11; 52/222; 52/478; 52/506.05; 52/522; 52/533; 52/537; 52/730.1; 52/783.14; 52/798.1; 405/118

(58) Field of Search ..... 52/11, 222, 302.3, 52/478, 506.04, 522, 533, 537, 730.1, 783.14, 798.1; 405/118

(56) References Cited

U.S. PATENT DOCUMENTS 3,066,771 A * 12/1962 Wolchuk
5,195,281 A * 3/1993 Kosko ..... 52/11
5,511,351 A * 4/1996 Moore ..... 51/302.1
5,765,328 A * 6/1998 Moore ..... 52/302.1
6,164,019 A * 12/2000 Salley ..... 52/11
6,226,941 B1 * 5/2001 Stevens ..... 52/302.3
6,260,316 B1 * 7/2001 Davis et al. ..... 52/302.3
6,385,931 B1 * 5/2002 Risser ..... 52/302.1
6,415,571 B2 * 7/2002 Risser ..... 52/302.1
6,421,967 B1 * 7/2002 Wlaker ..... 52/198

* cited by examiner

*Primary Examiner*—Carl D. Friedman
*Assistant Examiner*—Yvonne M. Horton
(74) *Attorney, Agent, or Firm*—Alfred F. Hoyte, Jr.

(57) ABSTRACT

A deck drainage system having a plurality of channeled drainage panels. The drainage panels are mounted to direct water flow transversely of the deck joists to a gutter, the panels connected to and suspended from the underside of the joists. The gutter is mounted transversely across the discharge ends of the drainage panels to collect water therefrom and direct it to a down spout. Drainage panels, which are rectangular with the individual drainage channels extending lengthwise, may be overlapped both lengthwise and widthwise to fit the perimeter of the deck.

4 Claims, 4 Drawing Sheets

MODULAR DECK DRAINAGE SYSTEM

BACKGROUND OF THE INVENTION

1. Field of the Invention

The present invention concerns drainage systems. More particularly, the invention is directed to a drainage system specifically designed to drain water dripping between floor boards of outdoor decks.

2. Description of the Prior Art

As outdoor decks have become more popular, efforts to fully utilize the area below the decks have generally been limited as the floor boards and joists of a typically constructed deck allow water to drip through and onto the area beneath the deck. Accordingly, deck drainage systems have been devised to capture and channel water away from the area below the deck. While these systems are generally effective, they suffer from two major drawbacks. First, the systems are difficult and time consuming to install, often requiring custom built drainage sections. Second, the systems are expensive.

U.S. Pat. No. 6,260,316 issued to Davis, et al. discloses one such drainage system. The system includes a plurality of U-shaped drainage sections, each of the sections having a width corresponding to the spacing of the floor joists of the deck. Installation is effected by securing the drainage panel to opposing interior sides of adjacent joists. While this system does conserve some "headroom" it suffers from the drawback in that one drainage panel is required for every two floor joists, which substantially increases installation time. Also, improper construction will result in leakage between the side of the joist and the edge of the drainage panel. Caulking or other sealant may be needed over time regardless of the method used to join drainage panels to floor joists.

Another deck drainage system that collects and channels water running through the cracks in a deck floor is disclosed in U.S. Pat. No. 4,065,883 to Thibodeau. Thibodeau utilizes a plurality of prefabricated gutters designed to be installed while the deck is under construction. Each gutter is fabricated with a base that slopes downwardly from one end to the other to facilitate the flow of water. The gutters rest between and on the deck joists, supported by flanges extending outwardly from the upstanding side members. This system suffers from the drawback that the gutters must be manufactured at one site and then transported to the installation site. Once installed, Thibodeau's drainage system may not be removed without extensive destruction of the deck.

U.S. Pat. No. 4,860,502 to Mickelsen discloses a drainage system for decks that may be installed on existing decks. Mickelsen utilizes gutter hangers fastened at an incline to the interior surface of two adjacent deck joists. A gutter panel is then coupled between the two gutter hangers. As in Thibodeau, Mickelsen requires the gutter hangers and panels to be custom fabricated at one site and then transported to the installation site. Additionally, the deck joists remain visible in both designs.

SUMMARY OF THE INVENTION

The present invention is directed to a deck drainage system having a plurality of channeled drainage panels. The drainage panels are mounted to direct water flow transversely of the deck joists to a gutter, the panels connected to and suspended from the underside of the joists. The gutter is mounted transversely across the discharge ends of the drainage panels to collect water therefrom and direct it to one or more down spouts. Drainage panels, which are rectangular with the individual drainage channels extending lengthwise, may be overlapped both lengthwise and widthwise to fit the perimeter of the deck.

It is a major object of this invention to provide an improved deck drainage system.

It is another object to provide a deck drainage system which is modular and adaptable to fit any size deck.

It is another object to provide a deck drainage system comprised of a plurality of identically sized drainage panels, each having a predetermined number of water drainage channels.

It is another object to provide a deck drainage system which can be installed beneath virtually any deck and does not require any customization.

Finally, it is a general goal of the invention to provide improved elements and arrangements thereof in an apparatus for the purposes described which is dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered with the accompanying drawings, in which like reference characters designate the same or similar parts throughout the several views, and wherein.

DETAILED DESCRIPTION OF THE PREFERRED EMBODIMENTS

Figure 1:
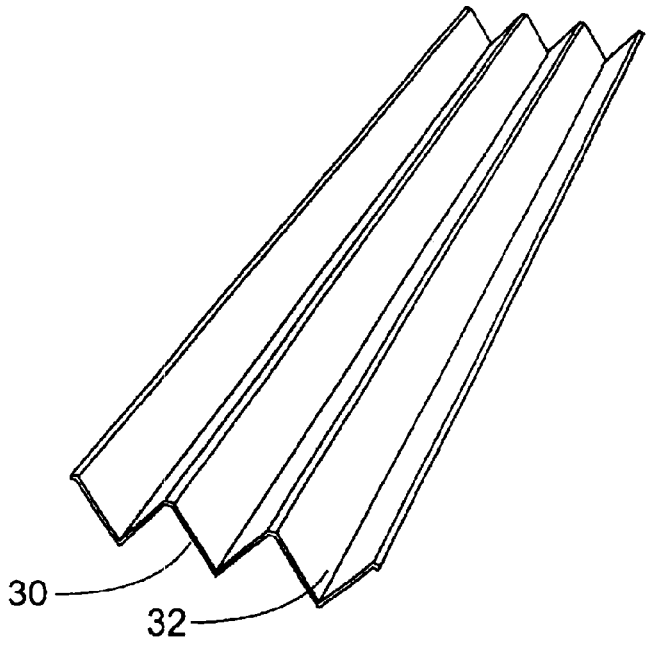
FIG. 1 is a perspective view of one of the drainage panels of the modular deck drainage system of the present invention.
Figure 2:
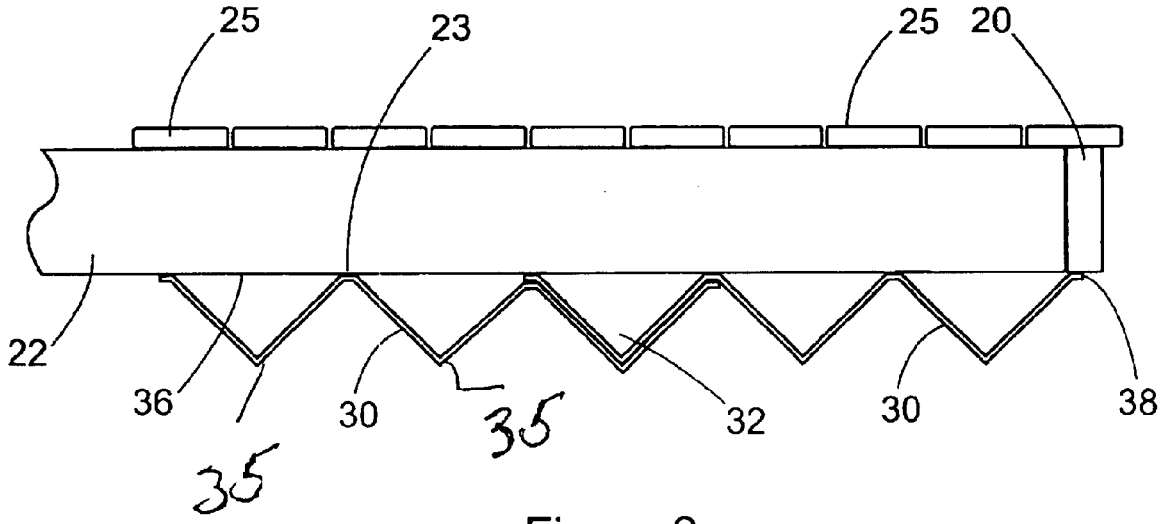
FIG. 2 is a side cross sectional view of a deck employing the drainage control system of the invention.
Figure 3:
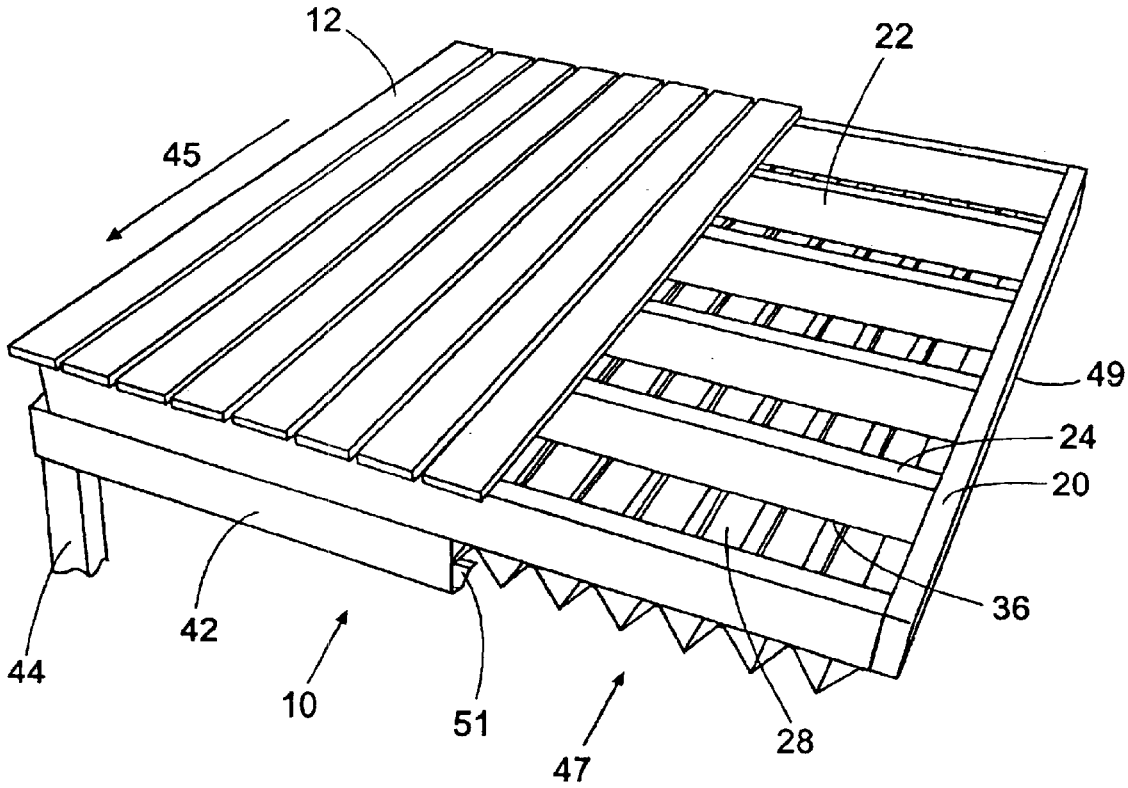
FIG. 3 is a perspective view, partially broken away, of a deck employing the drainage control system of the invention.

Referring now to FIGS. 1–5, the modular deck drainage system of the present invention, generally indicated by the numeral 10, is shown in position on a deck 12. FIG. 3 depicts a typical deck construction having a main support frame comprising four support beams 20 arranged in a rectangular configuration and connected at their ends. The deck 12 is raised, relative to the ground, by connecting the frame to additional support members (not shown), the additional support members connected to a primary structure such as a house. A plurality of elongated, parallel, generally rectan gular deck joists 22 are connected between the support beams 20 at regularly spaced intervals.

Transversely disposed across the top edges 24 of the joists 22, in spaced relation so as to provide a series of parallel drainage cracks, are a plurality of floor boards 25. The drainage cracks allow water to drain from the floor boards to prevent undesirable pooling of water on the deck 12, and to minimize the amount of time water is in contact with the wood, which increases the lifespan of the deck 12 and reduces required maintenance. Often, however, it is desirable to construct another living space beneath the deck 12 such as an enclosed porch, and thus there is a need to control water flowing through the drainage cracks.

In accordance with one aspect of the invention, a plurality of drainage sheets 30 are employed to form a drainage surface 28 to capture and redirect water draining from the deck 12. The sheets 30 are substantially rectangular and have at least three drainage channels 32 formed therein, the channels having a substantially triangular cross-sectional profile. Preferably, the drainage panels 30 are formed of a semi rigid, deformable material such as aluminum or PVC plastic which is creased to form channels 32. The resulting panel 30 is deformable allowing the width thereof to be adjusted. Intermediate flat regions 31 disposed between and serving to connect adjacent channels 32 facilitate connection of the upper surface of panel 30 to the bottom surfaces of joists 22 by providing a flat surface area for flush mounting at the attachment points to the floor joists 22.It can be seen that each panel 30 has a total of five folds with the "lower" folds 35 having no flat region and the "upper" folds having flat regions 31, the geometric variance allowing a user to quickly discern the intended top side of the panel 30. Also, the flat regions 31 allow for ease of forming apertures and inserting the fastening means 23. It can be appreciated that any apertures formed should be uniform to allow for insertion of a selected standard sized fastening means therethrough so as to form a water tight connection between panel 30 and joist 22. The top side 33 of each drainage panel would be the side having flat regions 31, with the reverse side or underside having a standard corrugated panel fold 35 with no flat region. It can be appreciated that folds 35 would essentially form the bottom of the "trough" which conducts water to gutter 42. Thus, if the panel 30 need be pre-stained or painted to a specific color, the top side 33. which would not be visible as it faces the underside of th deck 20, need not be painted.

Figure 4A:
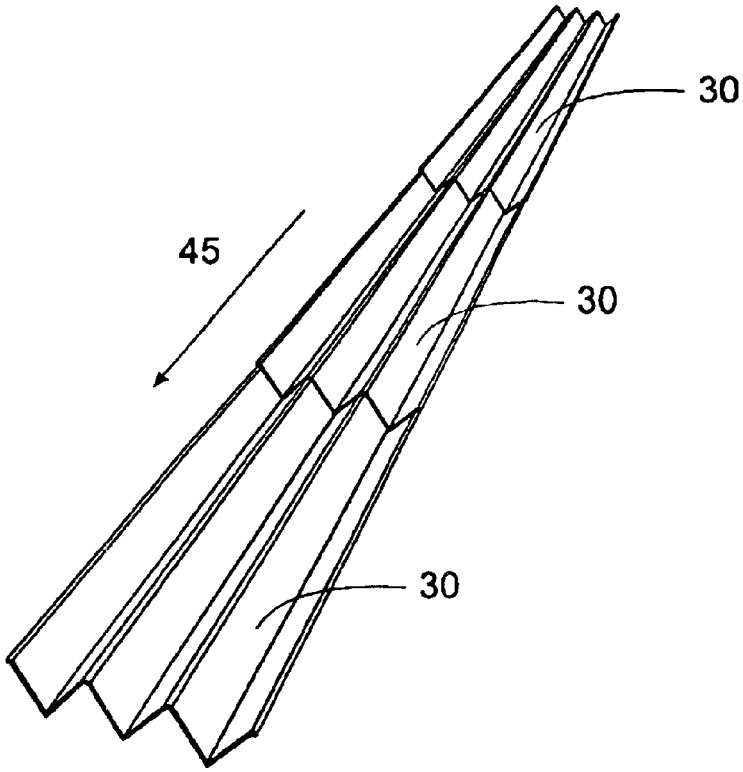
FIG. 4(A) shows a plan view, partly in section, of three drainage panels arranged end to end in accordance with one aspect of the invention.
Figure 4B:
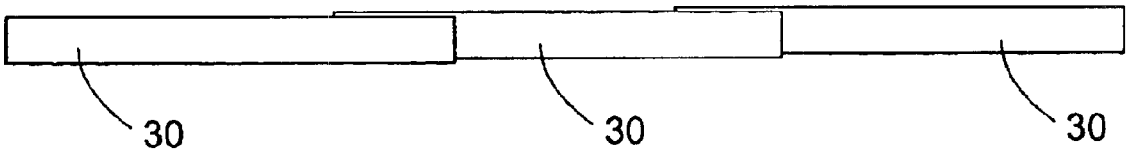
FIG. 4(B) shows a side view, partly in section, of the drainage panels in FIG. 4(*a*), illustrating the variable overlap of adjacent end to end panels.
Figure 5:
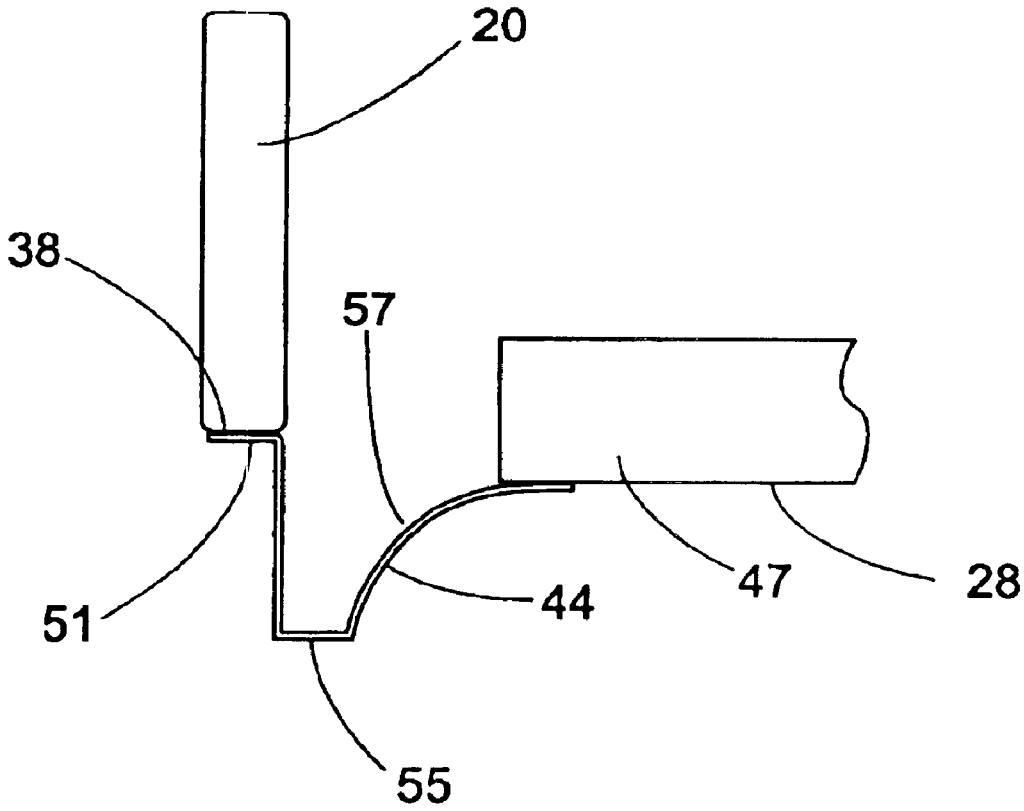
FIG. 5 shows an end view, partly in section, detailing the connection of a gutter.

The drainage panels 30 are mounted beneath the joists 22 and securely fastened to the lower edges 36, 38 of the joists 22 and support beams 20, respectively as by nails, screws, or other mechanical fasteners 23. It can be seen that the channels 32 of drainage panels 30 run perpendicular to the joists 22, obviating the need for placing caulking or other sealant between the joist 22 and the panel 30, which are typically fabricated from dissimilar materials as in many prior deck drainage systems. To reduce any possibility of leakage between adjacent panels 30 placed in side by side relation, and to adjust the collective width of the panels 30 to fit the size of the deck 12, the panels 30 may be arranged in partially overlapped relation by nesting at least one channel 32 within another as shown in FIG. 2. In lieu of the overlapped placement, and to reduce the number of drainage panels 30 needed, adjacent side by side panels 30 may be caulked along overlapped edge portions 39, or otherwise sealed to ensure a water tight drainage surface 28. To reduce the possibility of leakage between adjacent panels 30 placed end to end as shown in FIG. 4, the panels 30 may be overlapped so that a portion of each upstream panel overlies a portion of an adjacent downstream panel. Of course caulking or other means may be used to effect a seal between adjacent end to end panels 30. Thus, each successive panel 30 in the flow direction, as indicated by arrow 45, is placed beneath its predecessor. It can be appreciated that the flow direction 45 must be established to ensure one way water flow within channels 32 of the drainage panels 30. In order to facilitate one way flow, the panels 30 must be inclined so that the discharge end 47 of the drainage surface 28 is at a lower point than collection end 49. In the event the deck 12 is already inclined to ensure water flow away from the supporting structure, as is usually the case, the surface formed by panels 30 need only be parallel to the surface formed by floor boards 25. Various techniques may be employed to establish that floor boards 25 and panels 30 are mutually parallel, as would be apparent to one of skill in the art.

Attached to the bottom edge 38 of support beam 20 and depending therefrom, in water tight relation, is a mounting flange 51 formed at one edge of a gutter 42. The gutter 42 has a downwardly depending sidewall 53, a bottom panel 55, and a sidewall 57 having an arcuate cross section. The gutter 42 bridges the gap between discharge end 47 and support beam 20. Water may flow in either direction along the gutter 42, where it is directed to down spouts 44.

In accordance with another aspect of the invention, drainage panels 30 are packaged together with fasteners 23, panels 30, and gutters 42, as well as various end pieces and down spouts 44 as is known in the art. As decks 12 come in various sizes, drainage panels 30 may be selectively overlapped along both their width and their length, and compressed along their width in accordion like fashion. The packaged materials are preferably marked to indicate the maximum square footage for which coverage can be obtained.

In operation, once the area of the deck 12 is determined, pre-packaged materials having the appropriate number of drainage panels 30 can be purchased. The panels 30 are then fastened to the undersides of joists 22 and support beams 20, overlapping lengthwise and widthwise as required to fit the area of the deck 12. Gutter 42 and down spouts 44 are then attached using conventional materials and techniques.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A modular deck drainage system for mounting beneath a deck assembly, the deck assembly having spaced floor boards extending over a predetermined surface area, said floor boards supported by a plurality of regularly spaced joists, comprising:

a plurality of drainage panels each of said panels being of approximately the same length and width and having a plurality of longitudinally extending channels formed therein, said panels attached to bottom edges of said joists with said channels in transverse relation to said joists, adjacent drainage panels being arranged in adjustable overlapping relation both lengthwise and widthwise;

wherein said drainage panels are deployed to cover an area approximately equal to said predetermined surface area by adjusting the overlap of said adjacent panels, and wherein adjacent end to end drainage panels are overlapped, with a portion of each downstream panel connected beneath a portion of each immediately adjacent upstream panel, said drainage channels having upper and lower folds and a substantially triangular repeating cross sectional profile, said upper folds having flat regions connecting adjacent ones of said drainage panels.

2. The system of claim 1 wherein adjacent side by side panels are overlapped by nesting at least one of said channels of a first panel within at least one channel of a second panel.

3. The system of claim 1 wherein the overlap between adjacent end to end panels is adjusted to fit the surface area of said deck.

4. The system of claim 2 wherein the overlap between adjacent side by side panels is adjusted to fit the surface area of the deck.

* * * * *